US008457955B2

(12) United States Patent
Togawa et al.

(10) Patent No.: US 8,457,955 B2
(45) Date of Patent: Jun. 4, 2013

(54) VOICE REPRODUCTION WITH PLAYBACK TIME DELAY AND SPEED BASED ON BACKGROUND NOISE AND SPEECH CHARACTERISTICS

(75) Inventors: Taro Togawa, Kawasaki (JP); Takeshi Otani, Kawasaki (JP); Kaori Endo, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/409,544

(22) Filed: Mar. 1, 2012

(65) Prior Publication Data

US 2012/0158403 A1 Jun. 21, 2012

Related U.S. Application Data

(63) Continuation of application No. PCT/JP2009/065349, filed on Sep. 2, 2009.

(51) Int. Cl.
*G10L 21/02* (2006.01)

(52) U.S. Cl.
USPC ..... 704/227; 704/211; 704/226

(58) Field of Classification Search
None
See application file for complete search history.

(56) References Cited

U.S. PATENT DOCUMENTS

| | | | |
|---|---|---|---|
| 2006/0293883 | A1 | 12/2006 | Endo et al. |
| 2007/0265839 | A1 | 11/2007 | Sasaki et al. |

FOREIGN PATENT DOCUMENTS

| | | |
|---|---|---|
| JP | 10-49191 | 2/1998 |
| JP | 11-202896 | 7/1999 |
| JP | 2000-349893 | 12/2000 |
| JP | 2002-258881 | 9/2002 |
| JP | 2002-287800 | 10/2002 |
| JP | 2003-302990 | 10/2003 |
| JP | 2007-3682 | 1/2007 |
| JP | 2007-312040 | 11/2007 |
| JP | 2008-58956 | 3/2008 |
| WO | 2006/077626 | 7/2006 |
| WO | 2009/011021 | 1/2009 |

OTHER PUBLICATIONS

International Preliminary Report on Patentability mailed Apr. 19, 2012 issued in corresponding International Patent Application No. PCT/JP2009/065349.

*Primary Examiner* — Talivaldis Ivars Smits
(74) *Attorney, Agent, or Firm* — Staas & Halsey LLP

(57) ABSTRACT

A voice reproduction apparatus includes an ambient sound analysis unit to analyze a characteristic of an ambient sound, a characteristic analysis unit to analyze an acoustic characteristic of a signal for reproduction, a reproduction timing adjusting unit to record the signal for reproduction and to read the signal for reproduction at a reproduction timing of follow-up reproduction, a reproduction speed changing unit to change a reproduction speed of the read signal for reproduction, and a control unit to control the reproduction timing adjusting unit so that the signal for reproduction is reproduced at the reproduction timing corresponding to an analysis result of the ambient sound analysis unit and to control the reproduction speed changing unit so that the signal for reproduction is reproduced at the reproduction speed corresponding to the analysis result of the ambient sound analysis unit and the acoustic characteristic obtained by the characteristic analysis unit.

12 Claims, 10 Drawing Sheets

VOICE REPRODUCTION WITH PLAYBACK TIME DELAY AND SPEED BASED ON BACKGROUND NOISE AND SPEECH CHARACTERISTICS

CROSS-REFERENCE TO RELATED APPLICATIONS

This is a continuation of Application PCT/JP2009/065349, filed on Sep. 2, 2009, now pending, the entire contents of which are incorporated herein by reference.

FIELD

The embodiments discussed herein are related to a voice reproduction apparatus and a voice reproduction method.

BACKGROUND

In recent years, a mobile phone comes into widespread use, and the mobile phone is used in a variety of places. The mobile phone is used not only in quiet places but also in noisy environments such as the airport lobby and the railroad station platform.

Therefore, in order that a listener can easily hear the voice of a speaker in the noisy environment, a method is known, in which a high frequency region of the voice is emphasized depending on the ambient noise level (see, for example, Patent Document 1).

In the case of the method described in Patent Document 1, the voice is output at a level larger than that of the noise in a band to be emphasized. However, if the sound volume exceeds the limit of the output performance of a speaker, then the voice is distorted, and the sound quality is contrarily deteriorated in some cases. In another situation, it is feared that the high level output of the voice may exert any harmful influence on the auditory organ of the listener.

In view of the above, the following method has been suggested. That is, the received voice is recorded in a memory beforehand if the ambient noise level is large. When the ambient noise level is decreased, the simultaneous recording/reproduction (follow-up reproduction) is performed. Accordingly, the received voice can be heard with ease even in the highly noisy environment (see, for example, Patent Document 2).

[Patent Document 1] Japanese Laid-Open Patent Publication No. 11-202896

[Patent Document 2] Japanese Laid-Open Patent Publication No. 2007-312040

[Patent Document 3] Japanese Laid-Open Patent Publication No. 2002-258881

[Patent Document 4] Japanese Laid-Open Patent Publication No. 2007-003682

[Patent Document 5] Japanese Laid-Open Patent Publication No. 2002-287800

[Patent Document 6] Japanese Laid-Open Patent Publication No. 2000-349893

[Patent Document 7] Japanese Laid-Open Patent Publication No. 10-049191

SUMMARY

One aspect of the embodiments resides in a voice reproduction apparatus includes an ambient sound analysis unit to analyze a characteristic of an ambient sound, a characteristic analysis unit to analyze an acoustic characteristic of a signal for reproduction which is input, a reproduction timing adjusting unit to record the signal for reproduction on a recording medium on one hand and to read the signal for reproduction from the recording medium at a reproduction timing of follow-up reproduction on the other hand, a reproduction speed changing unit to change a reproduction speed of the signal for reproduction read from the recording medium, and a control unit to control the reproduction timing adjusting unit so that the signal for reproduction is reproduced at the reproduction timing corresponding to an analysis result of the ambient sound analysis unit on one hand and to control the reproduction speed changing unit so that the signal for reproduction is reproduced at the reproduction speed corresponding to the analysis result of the ambient sound analysis unit and the acoustic characteristic obtained by the characteristic analysis unit on the other hand.

The object and advantages of the embodiments will be realized and attained by means of the elements and combinations particularly pointed out in the claims.

It is to be understood that both the foregoing general description and the following detailed description are exemplary and explanatory and are not restrictive of the embodiments, as claimed.

DESCRIPTION OF EMBODIMENTS

In the case of the method described in Patent Document 2, the time delay is continuously increased, which is generated by the follow-up reproduction every time when the noise is increased. Even when the noise is small, the generated time delay is not restored. Therefore, a problem arises such that a long period of time is consumed until the received voice is completely heard.

The embodiments will be explained below with reference to the drawings. The arrangements of the embodiments are exemplification, and the mode of the voice reproduction apparatus and the voice reproduction method is not limited to the arrangements of the embodiments.

First Embodiment

Figure 1:
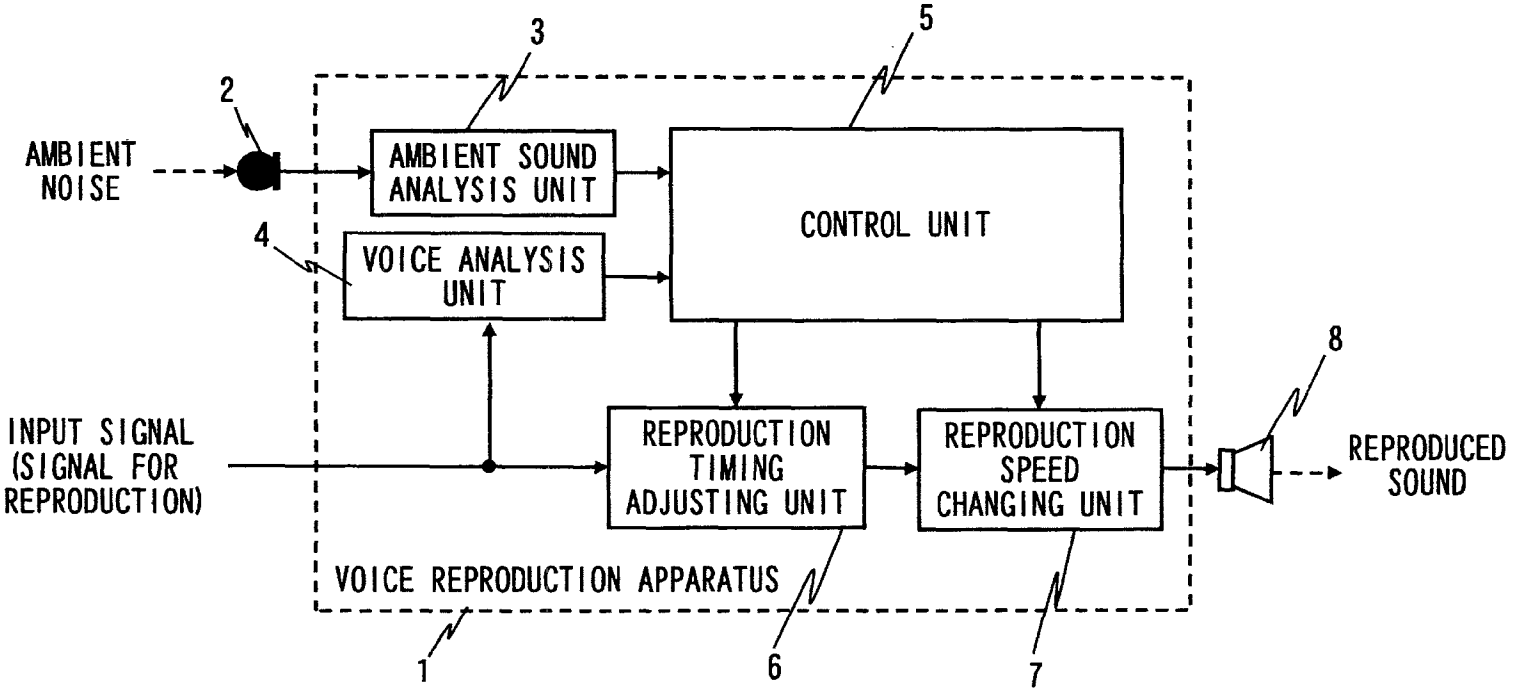
FIG. 1 illustrates a diagram illustrating an exemplary arrangement of a voice reproduction apparatus according to a first embodiment.

FIG. 1 is a diagram illustrating an exemplary arrangement of a voice reproduction apparatus according to a first embodiment. With reference to FIG. 1, the voice reproduction apparatus 1 includes an ambient sound analysis unit 3 which is connected to a microphone 2 for collecting the ambient sound around the voice reproduction apparatus 1, and a voice analysis unit 4 as a characteristic analysis unit into which an input signal, i.e., a signal for reproduction to be reproduced by the voice reproduction apparatus is input.

The voice reproduction apparatus 1 further includes a control unit 5 into which the outputs of the ambient sound analysis unit 3 and the voice analysis unit 4 are input, and a reproduction timing adjusting unit 6 into which the input signal and the output from the control unit 5 are input.

The voice reproduction apparatus 1 further includes a reproduction speed changing unit 7 into which the output from the reproduction timing adjusting unit 6 and the output from the control unit 5 are input. The reproduction speed changing unit 7 is connected to a speaker 8 which is provided to output the reproduced sound.

The output signal from the microphone 2, which indicates the situation of generation of the ambient noise around the voice reproduction apparatus 1, is input into the ambient sound analysis unit 3. The ambient sound analysis unit 3 analyzes the characteristic or feature of the ambient noise (also referred to as "ambient sound") from the output signal which indicates the situation of generation of the ambient noise.

The input signal as the reproduction objective, i.e., the signal for reproduction is input into the voice analysis unit 4. The voice analysis unit 4 analyzes the acoustic characteristic or feature of the signal for reproduction.

The control unit 5 determines the reproduction timing and the reproduction speed of the signal for reproduction on the basis of the analysis result of the ambient sound input from the ambient sound analysis unit 3, i.e., the characteristic of the ambient sound and the analysis result of the signal for reproduction obtained by the voice analysis unit 4, i.e., the acoustic characteristic of the signal for reproduction. The control unit 5 instructs the reproduction timing adjusting unit 6 to use the determined reproduction timing, and the control unit 5 instructs the reproduction speed changing unit 7 to use the determined reproduction speed.

The reproduction timing adjusting unit 6 adjusts the reproduction timing of the signal for reproduction in accordance with the instruction from the control unit 5. That is, the reproduction timing adjusting unit 6 gives the signal for reproduction to the reproduction speed changing unit 7 in accordance with the reproduction timing.

The reproduction speed changing unit 7 changes the reproduction speed of the signal for reproduction in accordance with the instruction from the control unit 5, and the reproduced signal is connected to the speaker 8. Owing to the arrangement as described above, the control unit controls the reproduction timing adjusting unit 6 and the reproduction speed changing unit 7 on the basis of the analysis result of the ambient sound analysis unit and the analysis result of the voice analysis unit so that the following operation is performed in the voice reproduction apparatus 1.

That is, the signal for reproduction, which is input in the noisy state as indicated by the analysis result of the ambient sound analysis unit 3, is held by the reproduction timing adjusting unit 6. After that, the signal for reproduction is delivered from the reproduction timing adjusting unit 6 to the reproduction speed changing unit 7 if the analysis result of no noise is indicated by the ambient sound analysis unit 3. The reproduction speed changing unit 7 performs the reproducing process for reproducing the signal for reproduction at the reproduction speed corresponding to the acoustic characteristic of the signal for reproduction.

Accordingly, the signal for reproduction, which is input in the noisy environment, can be reproduced at the accelerated speed which is faster than 1× speed, at the reproduction timing after the disappearance of the noise. Thus, the voice, which is input in the noisy environment, can be reproduced within a short time in the environment in which the voice can be heard with ease. Accordingly, a user of the voice reproduction apparatus 1 can hear the reproduced voice in a state in which the delay is suppressed. Therefore, it is possible to appropriately apply the voice reproduction apparatus 1 in order to perform the telephone conversation. That is, the voice reproduction apparatus 1 can be applied to the electronic equipment having the telephone conversation function such as the telephone set, the smart phone, and the personal computer.

Second Embodiment

Figure 2:
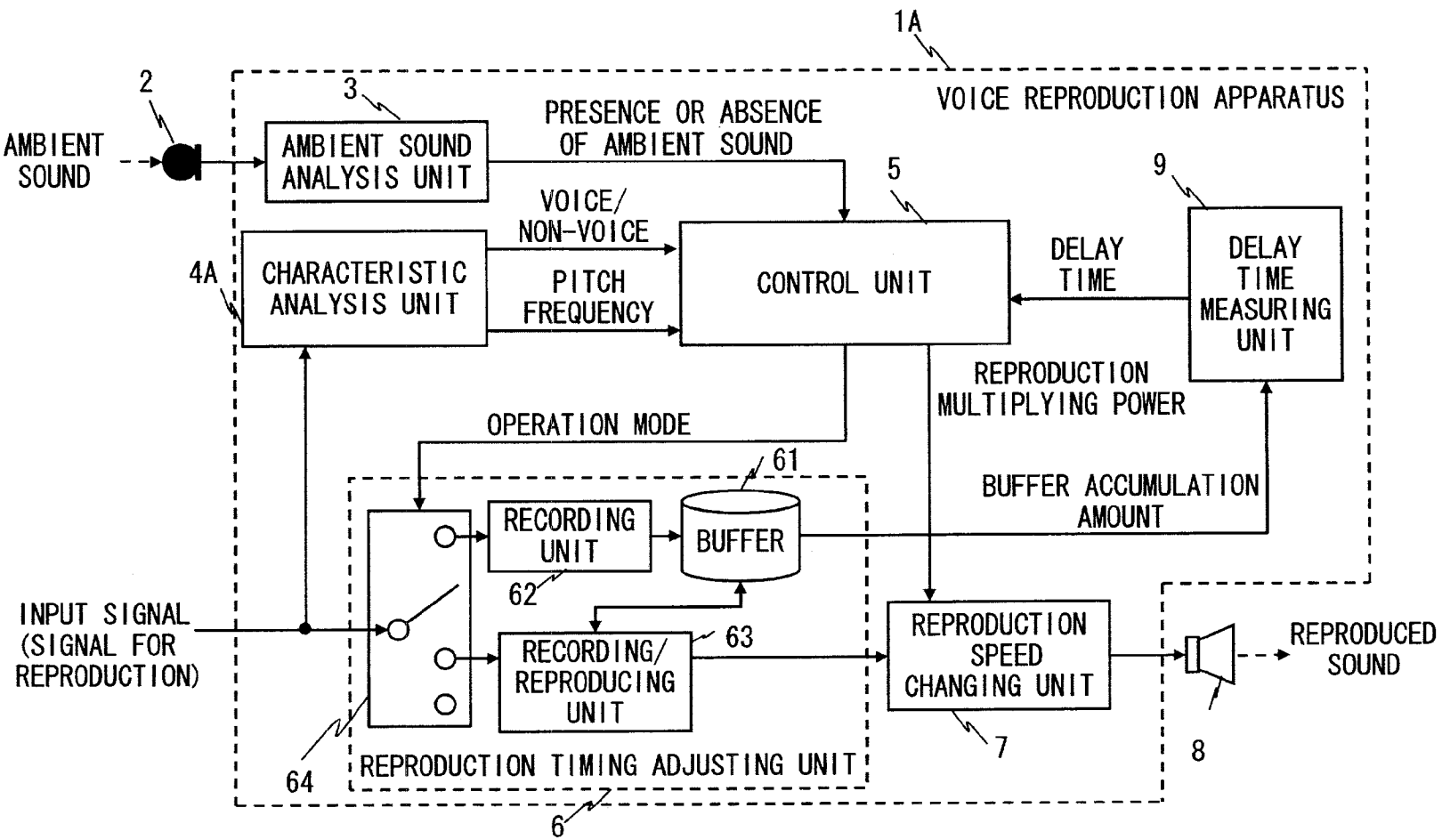
FIG. 2 illustrates a diagram illustrating an exemplary arrangement of a voice reproduction apparatus according to a second embodiment.

FIG. 2 illustrates an exemplary arrangement of a voice reproduction apparatus according to a second embodiment (voice reproduction apparatus 1A). In the voice reproduction apparatus 1A, the reproduction timing is deviated (shifted) for the signal for reproduction input into the voice reproduction apparatus 1A if the noise level (also referred to as "ambient sound level") is large, and the speaking speed can be changed during the reproduction or playback depending on the pitch frequency of the signal for reproduction.

The voice reproduction apparatus 1A can be applied, for example, to the electronic equipment having the telephone conversation function such as the mobile phone, the smart phone, and the personal computer as well as to the electronic equipment having such function that a voice file or a moving image file equipped with voice can be downloaded and reproduced. Alternatively, the voice reproduction apparatus 1A can be also applied to the receiving apparatus for receiving the voice signal such as the radio receiver and the television receiver.

With reference to FIG. 2, the voice reproduction apparatus 1A includes an ambient sound analysis unit 3 which is connected to a microphone 2 for inputting the ambient noise thereinto, and a characteristic analysis unit 4A into which an input signal, i.e., a signal for reproduction is input. The signal for reproduction is, for example, an incoming conversation signal supplied from another party in communication, a signal of moving image voice data, or a broadcasting voice signal of the radio or the television. The signal for reproduction includes a voice interval and a non-voice interval (including a silent interval). The signal, which is provided in the voice interval, is referred to as "voice signal", and the signal, which is provided in the non-voice interval, is referred to as "non-voice signal".

The voice reproduction apparatus 1A further includes a control unit 5 into which the outputs of the ambient sound analysis unit 3 and the characteristic analysis unit 4A are input, and a reproduction timing adjusting unit 6 into which the signal for reproduction and the output from the control unit 5 are input.

The voice reproduction apparatus 1A further includes a reproduction speed changing unit 7 into which the output from the reproduction timing adjusting unit 6 and the output from the control unit 5 are input, and a delay time measuring unit 9 which is connected to the reproduction timing adjusting unit 6 and the control unit 5. The reproduction speed changing unit 7 is connected to a speaker 8 for outputting the reproduced sound.

The reproduction timing adjusting unit 6 includes an output selection unit 64 which reads the signal for reproduction input from the outside and which outputs the signal for reproduction to the output destination corresponding to the operation mode input from the control unit 5, a recording unit 62 which records the signal for reproduction input from the output selection unit 64 in a buffer 61 as a recording medium, and a recording/reproducing unit 63 which records the signal for reproduction supplied from the output selection unit 64 as the data in the buffer 61 and which generates and outputs the signal for reproduction from the data recorded in the buffer 61.

The ambient sound analysis unit 3 analyzes the signal (referred to as "ambient sound signal") input from the microphone 2 for collecting the ambient noise around the voice reproduction apparatus 1A, and the ambient sound analysis unit 3 outputs the judgment result to indicate whether the ambient sound is present or absent.

Specifically, the ambient sound analysis unit 3 performs the analysis of the ambient sound signal every time when the unit time elapses, and the ambient sound analysis unit 3 measures, for example, the noise level of the ambient sound signal in relation to every unit time. The ambient sound analysis unit 3 judges whether or not the noise level in relation to every unit time is less than a predetermined threshold value TH1. When the noise level is less than the threshold value TH1, the ambient sound analysis unit 3 outputs the judgment result of "small ambient sound". When the noise level is equal to or more than the threshold value TH1, the ambient sound analysis unit 3 outputs the judgment result of "large ambient sound". In this way, the judgment result, which indicates the presence or absence of the ambient sound (noise) in relation to every unit time, is output, and the judgment result is input into the control unit 5. The threshold value TH1 can be determined while considering whether or not the magnitude of the ambient sound (noise level) affects the hearing or listening of the reproduced sound by a user.

The characteristic analysis unit 4A analyzes the characteristic of the input signal (signal for reproduction) in relation to every unit time. The characteristic analysis unit 4A inputs, into the control unit 5, the judgment result to indicate whether the signal for reproduction in relation to the unit time is the voice signal or the non-voice signal, as the analysis result. When the signal for reproduction is the voice signal, then the characteristic analysis unit 4A measures the pitch frequency of the voice signal, and the pitch frequency is input into the control unit 5. The judgment to judge whether the signal for reproduction is the voice signal or the non-voice signal is performed, for example, in accordance with a method described in Patent Document 3 (Japanese Laid-Open Patent Publication No. 2002-258881).

The pitch frequency can be calculated by using, for example, the following expressions (1) and (2).

[formula 1]

$$\mathrm{corr}(a) = \frac{\sum_{i=0}^{M-1} x(i-a)x(i)}{\sqrt{\sum_{i=0}^{M-1} x(i-a)^2}\sqrt{\sum_{i=0}^{M-1} x(i)^2}} \tag{1}$$

$$\mathrm{pitch} = freq/\mathrm{a_max} \tag{2}$$

wherein:

x: signal of outgoing conversation signal

M: length of interval for calculating correlation coefficient (sample)

a: start position of signal for calculating correlation coefficient pitch: pitch frequency (Hz)

corr(a): correlation coefficient when deviation position is "a"

a_max: "a" corresponding to maximum correlation coefficient i: index of signal (sample)

freq: sampling frequency (Hz)

The output selection unit 64 of the reproduction timing adjusting unit 6 switches the output destination of the signal for reproduction among the recording unit 62, the recording/reproducing unit 63, and "no output (terminal end)" depending on the control signal, supplied from the control unit 5, to indicate the operation mode.

The operation mode includes the "recording/reproduction" mode in which the simultaneous recording/reproduction (follow-up reproduction) is performed such that the signal for reproduction received from the reproduction timing adjusting unit 6 is recorded in the buffer 61 while the signal for reproduction based on the data read from the buffer 61 is reproduced, the "recording" mode in which the signal for reproduction input into the reproduction timing adjusting unit 6 is recorded in the buffer 61, and the "no processing" mode in which no process is performed for the signal for reproduction which is input.

If the operation mode is "recording/reproduction", the output selection unit 64 outputs the signal for reproduction to the recording/reproducing unit 63. On the other hand, if the operation mode is "recording", the output selection unit 64 outputs the signal for reproduction to the recording unit 62. Further, if the operation mode is the "no processing" mode, the output selection unit 64 does not output the signal for reproduction which is input.

The recording unit 62 performs the writing process in which the signal for reproduction output from the output selection unit 64 is accumulated as the data in the buffer 61 in the operation mode of "recording". In the "recording/reproduction" mode, the recording/reproducing unit 63 generates and outputs the signal for reproduction based on the data read from the buffer 61, while the recording/reproducing unit 63 accumulates the signal for reproduction supplied from the output selection unit 64 as the data in the buffer 61 so that the writing process is performed. The signal for reproduction, which is the output of the recording/reproducing unit 63, is input into the reproduction speed changing unit 7.

The reproduction speed changing unit 7 outputs the signal for reproduction at the reproduction speed in accordance with the reproduction multiplying power instructed by the control unit 5. Accordingly, the reproduced sound, which is at the reproduction speed adjusted by the reproduction speed changing unit 7, is output from the speaker 8.

The delay time measuring unit 9 acquires the length of the signal for reproduction, i.e., the accumulation amount accumulated in the buffer 61 in order to adjust the reproduction timing. The delay time is calculated from the accumulation amount, and the delay time is input into the control unit 5.

The control unit 5 determines the operation mode for every unit time and the reproduction multiplying power on the basis of the judgment result to indicate whether the "ambient sound is present" or the "ambient sound is absent", the judgment result to judge whether the interval is the "voice interval" or the "non-voice interval", the pitch frequency, and the delay time. The determined operation mode is notified to the reproduction timing adjusting unit 6, and the reproduction multiplying power is notified to the reproduction speed changing unit 7.

If it is judged by the ambient sound analysis unit 3 that the ambient sound level is small and the delay time, which is measured by the delay time measuring unit 9, is zero, then the control unit 5 performs the control so that the ordinary reproduction, i.e., the reproduction at 1× speed is performed. On the other hand, if it is judged by the ambient sound analysis unit 3 that the ambient sound level is large and the delay is less than a predetermined threshold value TH2, then the control unit 5 performs the control so that the reproduction timing is adjusted. In the case of any situation other than the above, the control unit 5 performs the control so that the short time reproduction is performed.

It is noted that the ambient sound analysis unit 3, the characteristic analysis unit 4A, the control unit 5, the reproduction timing adjusting unit 6, and the reproduction speed changing unit 7 can be realized, for example, as the functions realized by applying exclusive hardware circuits.

Alternatively, the ambient sound analysis unit 3, the characteristic analysis unit 4A, the control unit 5, the reproduction timing adjusting unit 6, and the reproduction speed changing unit 7 can be also realized as the functions generated such that a processor (not illustrated) such as CPU (Central Processing Unit) or DSP (Digital Signal Processor) executes the program stored in a memory (recording medium, not illustrated). The buffer 61 is realized by a recording medium (for example, a semiconductor memory such as RAM or flash memory).

Further alternatively, the ambient sound analysis unit 3, the characteristic analysis unit 4A, the reproduction timing adjusting unit 6, and the reproduction speed changing unit 7 may be realized by exclusive hardware, and the control unit 5 may be realized by software processing brought about by any exclusive or general-purpose processor.

The arrangement illustrated in FIG. 2 is illustrated by way of example in every sense. It is possible to provide a modification so that the function, which is possessed by each of the blocks illustrated in FIG. 2, is realized by a plurality of blocks. Alternatively, it is possible to provide a modification so that the functions, which are possessed by a plurality of the blocks illustrated in FIG. 2, are realized by one block. Further alternatively, it is possible to provide a modification so that a part of the function of a certain block is realized by another block.

Figure 3:
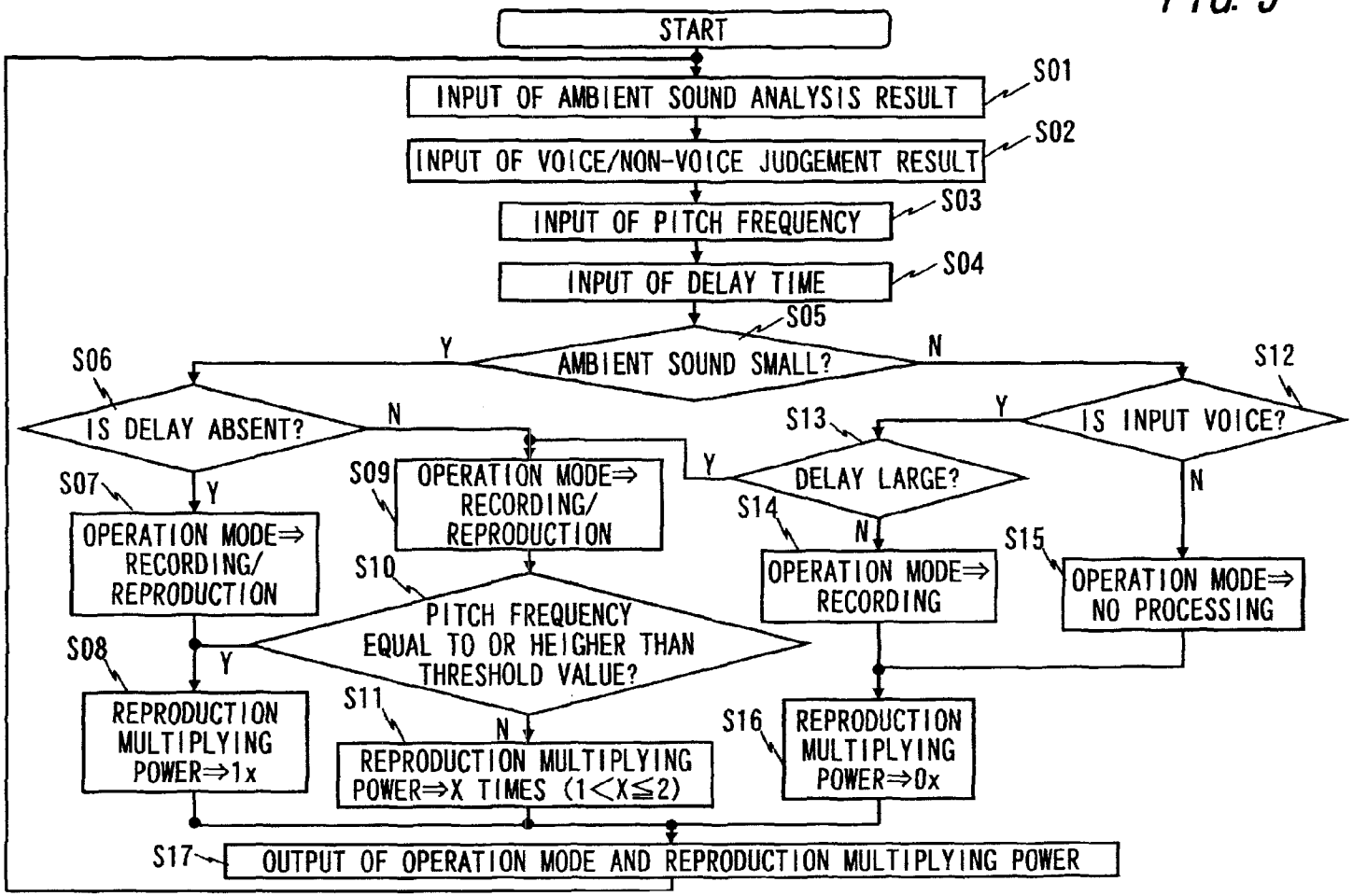
FIG. 3 illustrates a flow chart illustrating an exemplary process performed by a control unit according to the second embodiment.

FIG. 3 illustrates a flow chart illustrating an exemplary process performed by the control unit 5 illustrated in FIG. 2. The process illustrated in FIG. 3 is started by using, for example, the trigger of the fact that an unillustrated power source of the voice reproduction apparatus 1A is turned ON.

The process illustrated in FIG. 3 is executed every time when the unit time or the predetermined period elapses while synchronizing the ambient sound analysis unit 3, the characteristic analysis unit 4A, the control unit 5, the reproduction timing adjusting unit 6, the reproduction speed changing unit 7, and the delay time measuring unit 9.

At first, the control unit 5 receives the signal to indicate "small noise" or "large noise" as the judgment result obtained by the ambient sound analysis unit 3 (Step S01

Subsequently, the control unit 5 receives, from the characteristic analysis unit 4A, the judgment result to indicate whether the signal for reproduction is the voice signal or the non-voice signal (Step S02). In this procedure, when the signal for reproduction is the voice signal, the control unit 5 receives the pitch frequency of the voice signal from the characteristic analysis unit 4A (Step S03). Therefore, when the signal for reproduction is the non-voice signal, the process of Step S03 is not performed.

Subsequently, the control unit 5 receives the delay time from the delay time measuring unit 9 (Step S04). Subsequently, the control unit 5 judges whether or not the judgment result of the ambient sound analysis unit 3 is "small ambient sound". In this procedure, if the judgment result is "small ambient sound" (S05 YES), the process proceeds to Step S06. On the other hand, if the judgment result is "large ambient sound" (S05 NO), the process proceeds to Step S12.

In Step S06, the control unit 5 judges whether or not the delay is present by judging whether or not the delay time is zero, i.e., whether or not the accumulation amount of the buffer 61 is zero. If the delay is absent (S06 YES), the process proceeds to Step S07. On the other hand, if the delay is present (S06 NO), the process proceeds to Step S09.

In Step S07, the control unit 5 sets the operation mode to "recording/reproduction". Subsequently, the control unit 5 sets the reproduction multiplying power to 1× (1 time) (Step S08). After that, the control unit 5 allows the process to proceed to Step S17 so that the operation mode "recording/reproduction" is given to the reproduction timing adjusting unit 6 and the reproduction speed "1×" is given to the reproduction speed changing unit 7. After that, the process returns to Step S01.

If it is judged in Step S06 that the delay is present and the process proceeds to Step S09, then the control unit 5 sets the operation mode to "recording/reproduction" (Step S09).

Subsequently, the control unit 5 judges whether or not the pitch frequency of the voice signal read from the buffer 61 is equal to or more than a threshold value TH3 (Step S10). In this procedure, when the pitch frequency is equal to or more than the threshold value TH3 (S10 YES), then the process proceeds to Step S08, and the reproduction multiplying power of the voice signal is set to 1×. On the other hand, when the pitch frequency is less than the threshold value TH3 (S10 NO), the process proceeds to Step S11.

In Step S11, the control unit 5 sets the reproduction multiplying power to X times (for example, $1<X\leqq 2$). The value of X can be set, for example, such that a map, which indicates the correlation between the pitch frequency and the reproduction multiplying power, is stored in the control unit 5 beforehand and the reproduction multiplying power corresponding to the pitch frequency is designated as X. When the reproduction multiplying power is raised, then the frequency of the voice is raised, and the easiness of hearing is improved.

After that, the process proceeds to Step S17, the control unit 5 gives the operation mode "recording/reproduction" to the reproduction timing adjusting unit 6, and the control unit 5 gives the reproduction speed "X times" to the reproduction speed changing unit 7. After that, the process returns to Step S01.

By the way, if the process proceeds from Step S05 to Step S12, the control unit 5 judges whether or not the input signal, i.e., the signal for reproduction is the voice signal. In this procedure, when the signal for reproduction is the voice signal (S12 YES), the process proceeds to Step S13. On the other hand, when the signal for reproduction is the non-voice signal (S12 NO), the process proceeds to Step S15.

In Step S13, the control unit 5 judges whether or not the delay time is equal to or more than the predetermined threshold value TH3. In this procedure, when the delay time is equal to or more than the threshold value TH3 (S13 YES), then the process proceeds to Step S09, and the operation mode is set to "recording/reproduction".

On the other hand, when the delay time is less than the threshold value TH3 (S13 NO), the control unit 5 sets the operation mode to "recording" (Step S14). Further, the control unit 5 sets the reproduction multiplying power to 0×. When the reproduction multiplying power is set to 0×, the reproduced sound output from the speaker 8 is stopped.

After that, the process proceeds to Step S17, the operation mode "recording" is given to the reproduction timing adjusting unit 6, and the reproduction speed "0×" is given to the reproduction speed changing unit 7. After that, the process returns to Step S01.

In Step S12, if it is judged that the signal for reproduction is the non-voice signal (S12 NO), then the control unit 5 sets the operation mode to "no processing" (Step S15), and sets the reproduction multiplying power to zero in Step S16. After that, the process proceeds to Step S17, the operation mode "no processing" is given to the reproduction timing adjusting unit 6, and the reproduction speed "0×" is given to the reproduction speed changing unit 7. After that, the process returns to Step S01.

In the operation mode "no processing", the signal for reproduction is not output from the output selection unit 64, and hence neither the reproduction nor the recording in the buffer 61 is performed. Therefore, only the voice signal is accumulated in the buffer 61.

According to the process illustrated in FIG. 3, if the ambient sound is small, and the delay is absent, then the signal for reproduction is reproduced at the reproduction multiplying power 1×, and the reproduced sound is output from the speaker 8. On the other hand, if the ambient sound is small, and the delay is present, then the signal for reproduction is recorded in the buffer 61. Accordingly, the reproduction timing adjustment is performed. On the other hand, the voice signal, which is recorded in the buffer 61, is reproduced at the reproduction multiplying power corresponding to the pitch frequency of the concerning voice signal.

On the other hand, if the ambient sound is large, and the delay is absent, then the voice signal is recorded in the buffer 61, and the output of the reproduced sound is stopped. Accordingly, the reproduction is regulated in the noisy environment, and it is possible to try the reproduction at the point in time at which the ambient sound is lowered.

If the ambient sound is large, and the delay is large as well, then the operation is performed in the same manner as in the case in which the ambient sound is small and the delay is present. That is, if the delay of reproduction is unable to be permitted although the ambient noise is large, then the reproduction multiplying power is optionally raised if necessary, so that the reproduced sound, which can be heard as easily as possible, is output.

In this way, if the ambient sound is small, and the delay is absent as well, then the voice reproduction apparatus 1A is operated so that the reproduced sound of the signal for reproduction is output at 1× speed without adjusting the reproduction timing. On the other hand, if the ambient sound is large, and the delay is small, then the voice reproduction apparatus 1A is operated so that the output of the reproduced sound is stopped to contemplate the adjustment of the reproduction timing. Further, if the ambient sound is small and the delay is present and if the ambient sound is large and the delay is large, then the voice reproduction apparatus 1A can be operated so that the reproduction speed is raised to perform the reproduction within a short time.

If the delay is also large although the ambient sound is large, then it is also allowable that the reproduction multiplying power X, which exceeds 1×, is set irrelevant to the magnitude of the pitch frequency. In this way, it is possible to decrease the accumulation amount of the buffer 61 within a short time.

Figure 4:
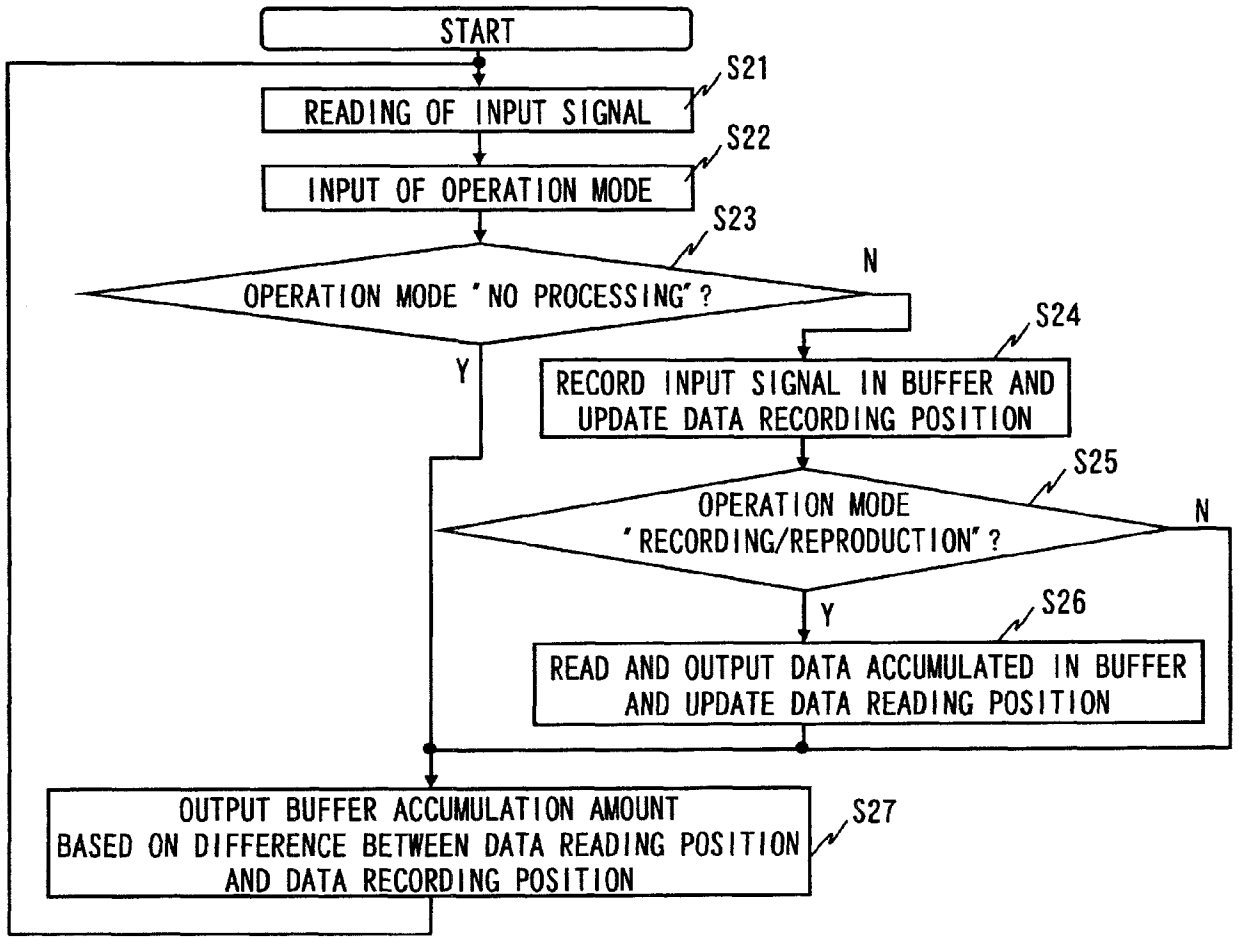
FIG. 4 illustrates a flow chart illustrating an exemplary process performed by a reproduction timing adjusting unit according to the second embodiment.

FIG. 4 illustrates a flow chart illustrating an exemplary operation performed by the reproduction timing adjusting unit 6 illustrated in FIG. 2. At first, the output selection unit 64 of the reproduction timing adjusting unit 6 reads the signal for reproduction (input signal) input from the outside into an unillustrated internal memory (Step S21).

Subsequently, the reproduction timing adjusting unit 6 receives the operation mode input from the control unit 5 (Step S22). The operation mode is written into the internal memory.

Subsequently, the reproduction timing adjusting unit 6 judges whether or not the operation mode is "no processing". In this procedure, if the operation mode is "no processing", the process proceeds to Step S27. In this procedure, the output of the signal for reproduction from the output selection unit 64 is not performed. On the other hand, if the operation mode is not "no processing", the process proceeds to Step S24. In this case, the output selection unit 64 outputs the signal for reproduction to the recording unit 62.

In Step S24, the signal for reproduction is recorded in the buffer 61 by the recording unit 62, and the data recording position of the buffer 61 managed by the reproduction timing adjusting unit 6 is updated.

In Step S25, the reproduction timing adjusting unit 6 judges whether or not the operation mode is "recording/reproduction". In this procedure, if the operation mode is "recording/reproduction" (S25 YES), the process proceeds to Step S26. On the other hand, if the operation mode is not "recording/reproduction" (S25 NO), the process proceeds to Step S27.

In Step S26, the reproduction timing adjusting unit 6 reads the data accumulated in the buffer 61 and the voice signal based on the data is output. The reproduction timing adjusting unit 6 updates the data reading position, which is managed by the reproduction timing adjusting unit 6. After that, the process proceeds to Step S27.

In Step S27, the reproduction timing adjusting unit 6 outputs the accumulation amount of the buffer 61 from the difference between the data reading position and the data recording position. The accumulation amount is input into the delay time measuring unit 9. After that, the process returns to Step S21.

In this way, the reproduction timing adjusting unit 6 judges whether or not the read signal for reproduction is the voice signal. When the signal for reproduction is the voice signal, the signal is accumulated in the buffer 61, while when the signal for reproduction is the non-voice signal, the signal is not accumulated in the buffer 61. Accordingly, it is possible to realize the process in which only the signal of the voice interval, i.e., only the voice signal is recorded and reproduced.

Figure 5:
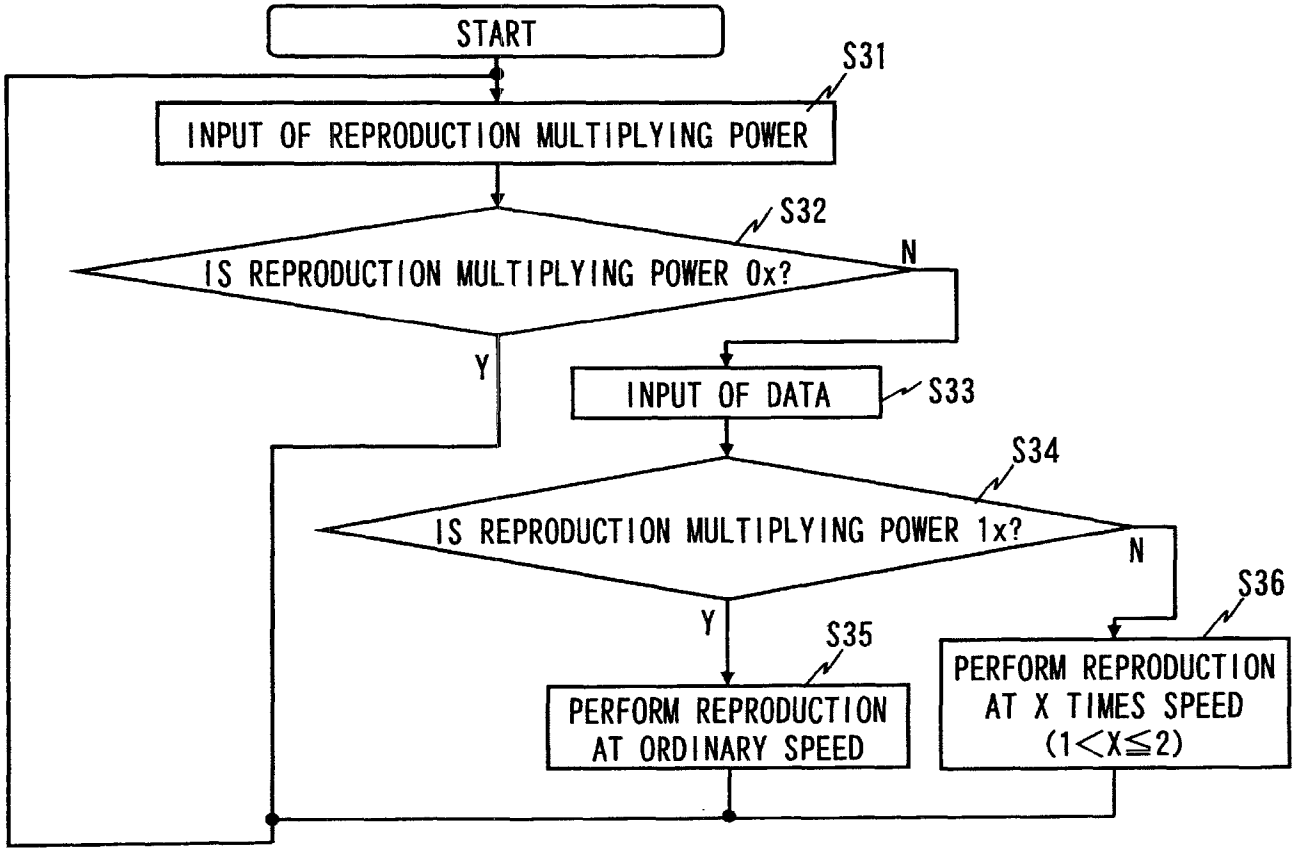
FIG. 5 illustrates a flow chart illustrating an exemplary process performed by a reproduction speed changing unit according to the second embodiment.

FIG. 5 illustrates a flow chart illustrating an exemplary operation (short time reproduction operation) performed by the reproduction speed changing unit 7 illustrated in FIG. 2.

At first, the reproduction speed changing unit 7 receives the reproduction multiplying power from the control unit 5 (Step S31). Subsequently, the reproduction changing unit 7 judges whether or not the reproduction multiplying power is 0× (Step S32). In this procedure, if the reproduction multiplying power is 0× (S32 YES), the reproduction speed changing unit 7 returns the process to Step S31 without performing the reproducing process. Therefore, any reproduced signal is not output from the speaker 8.

On the other hand, if the reproduction multiplying power is not 0× (S32 NO), the reproduction speed changing unit 7 reads the signal for reproduction output from the recording/reproducing unit 63 into the unillustrated internal memory included in the reproduction speed changing unit 7 (S33).

Subsequently, the reproduction speed changing unit 7 judges whether or not the reproduction multiplying power is 1× (Step S34). In this procedure, if the reproduction multiplying power is 1× (S34 YES), then the reproduction speed changing unit 7 performs the reproducing process at the ordinary speed (1×), and the reproduced signal is output to the speaker 8. Therefore, the reproduced signal at 1× speed is output from the speaker 8.

On the other hand, if the reproduction multiplying power is not 1× (S34 NO), the reproduction speed changing unit 7 performs the reproducing process at the reproduction speed X times instructed from the control unit 5 for the signal for reproduction output from the recording/reproducing unit 63 (S36). Therefore, the reproduced signal at X times speed is output from the speaker 8.

In this way, the reproduction speed is multiplied X times (provided that the maximum value is two times) larger than 1× by the reproduction speed changing unit 7, and thus the short time reproduction is realized.

According to the voice reproduction apparatus 1A of the second embodiment, if the ambient noise is large, only the voice signal is accumulated in the buffer 61 so that only the voice signal, which is included in the signal for reproduction, is subjected to the simultaneous recording/reproduction (follow-up reproduction).

Accordingly, it is possible to avoid any unnecessary increase in the delay time. On the other hand, if the ambient noise is small, the time delay can be shortened by performing the reproduction while quickening the speaking speed (quickening the reproduction speed). Therefore, the reproduced sound can be heard within a short time.

Therefore, for example, when the reproduction timing and the reproduction speed are controlled so that the time delay is equal to or less than a predetermined threshold value (for example, about 1 second), the voice reproduction apparatus 1A can be applied to the way of use of telephone conversation. In particular, it is possible to output the reproduced sound which can be heard with ease in relation to the noise such as the door closing sound or the alarm sound to be generated instantaneously.

According to the voice reproduction apparatus 1A, the reproduction timing can be deviated (subjected to the time shift) to the point in time at which the ambient noise is decreased, by the reproduction timing adjusting unit 6. Accordingly, it is possible to provide the reproduced sound which can be heard with ease.

According to the voice reproduction apparatus 1A, the signal for reproduction, which is accumulated in the buffer 61 during the period of "large ambient sound", can be limited to the voice signal. Accordingly, it is possible to decrease the amount of the signal for reproduction to be subjected to the follow-up reproduction. Therefore, it is possible to avoid any unnecessary increase in the time delay. Further, it is possible to reduce the memory amount needed for constructing the system of the voice reproduction apparatus 1A.

The voice reproduction apparatus 1A can be operated such that an amount of predetermined time, which is provided just before the noise is increased, is retraced to perform the reproduction when the reproduction timing is delayed. Accordingly, it is possible to avoid the decrease in the easiness of listening which would be otherwise caused by the follow-up reproduction performed from any intermediate point of the voice.

The voice reproduction apparatus 1A can quicken the reproduction speed at a portion such as the ending of a word at which the voice is lowered (portion at which the pitch frequency is low). Accordingly, it is possible to restore the time delay without lowering the easiness of hearing of the reproduced sound.

The voice reproduction apparatus 1A can restore the time delay without lowering the natural feature while maintaining the pitch frequency of the original voice by using the speaking speed converting technique in the reproduction speed changing unit 7. As for the speaking speed converting technique, it is possible to apply, for example, a technique described in Patent Document 4 (Japanese Laid-Open Patent Publication No. 2007-003682).

The voice reproduction apparatus 1A can execute the reproduction control so that the delay time is not increased. Accordingly, the reproduced sound can be heard with ease within a short time. In particular, the voice reproduction apparatus 1A can be applied to the telephone conversation.

The voice reproduction apparatus 1A can perform the reproduction timing adjustment and the reproduction speed changing process so that the time delay is equal to or more than the predetermined value in accordance with the judgment in Step S13.

Third Embodiment

Next, a voice reproduction apparatus according to a third embodiment will be explained. The third embodiment is constructed commonly to the second embodiment. Therefore, the common points or features are omitted from the explanation, and different points or features will be principally explained.

In the third embodiment, an explanation will be made about the voice reproduction apparatus in which the reproduction timing of the signal for reproduction is deviated if the noise level is large, and the reproduction speed can be changed depending on the voice interval length included in the signal for reproduction.

Figure 6:
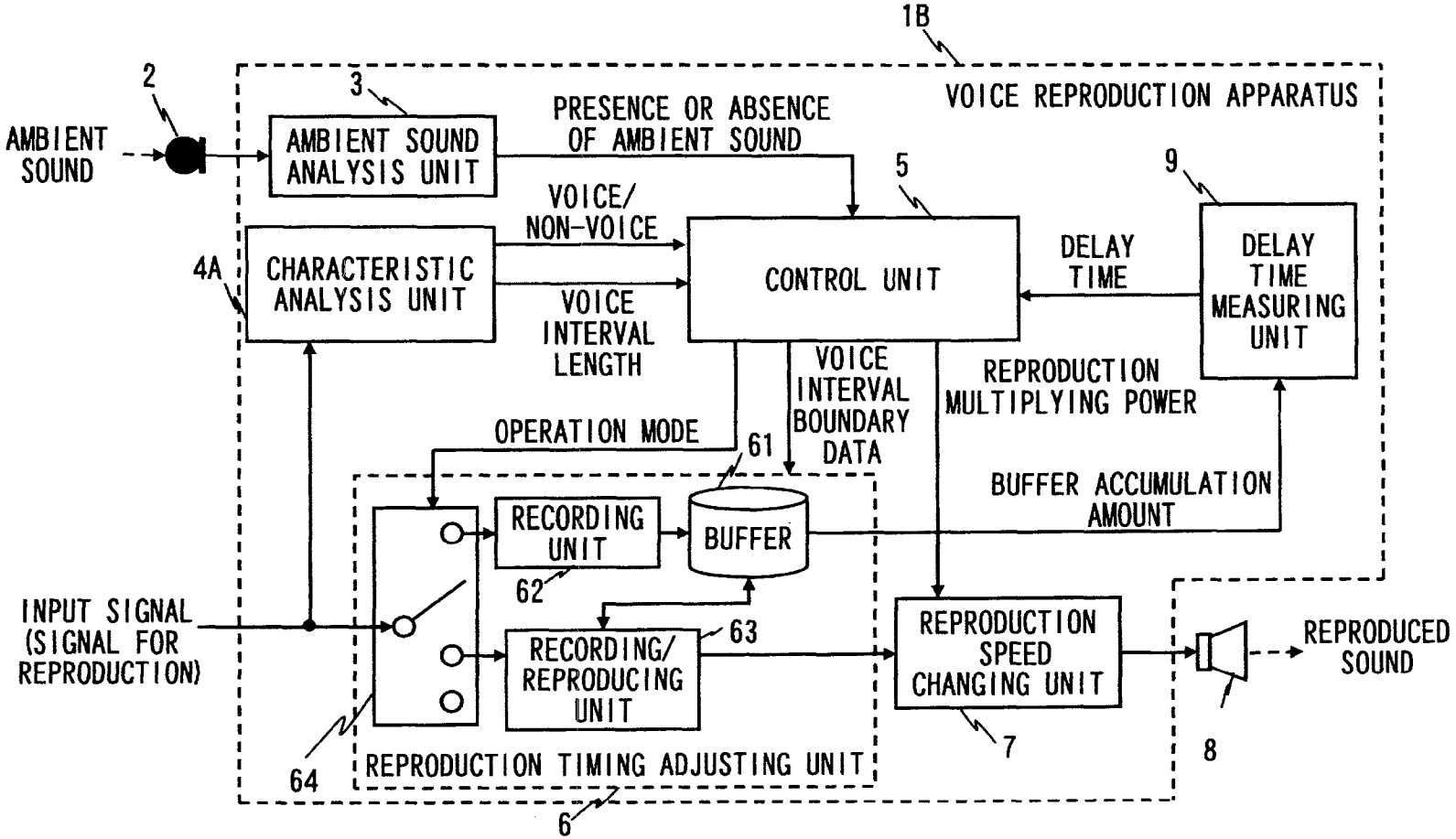
FIG. 6 illustrates a diagram illustrating an exemplary arrangement of a voice reproduction apparatus according to a third embodiment.

FIG. 6 is a diagram illustrating an exemplary arrangement of the voice reproduction apparatus 1B according to the third embodiment. The voice reproduction apparatus 1B illustrated in FIG. 6 is different from the voice reproduction apparatus 1A in relation to the following points or features.

(1) The characteristic analysis unit 4 inputs the voice interval length into the control unit 5 in place of the pitch frequency.

(2) The control unit 5 gives the voice interval boundary data based on the voice interval length to the reproduction timing adjusting unit 6. The voice interval boundary data is the data to indicate the start point in time of the voice interval.

(3) The control unit 5 determines the reproduction speed on the basis of the voice interval length.

(4) The recording/reproducing unit 63 reads the data from the buffer 61 so that the follow-up reproduction is started from the head of the voice interval on the basis of the voice interval boundary data.

The arrangement of the voice reproduction apparatus 1B is approximately the same as the arrangement of the voice reproduction apparatus 1A except for the foregoing features.

Figure 7:
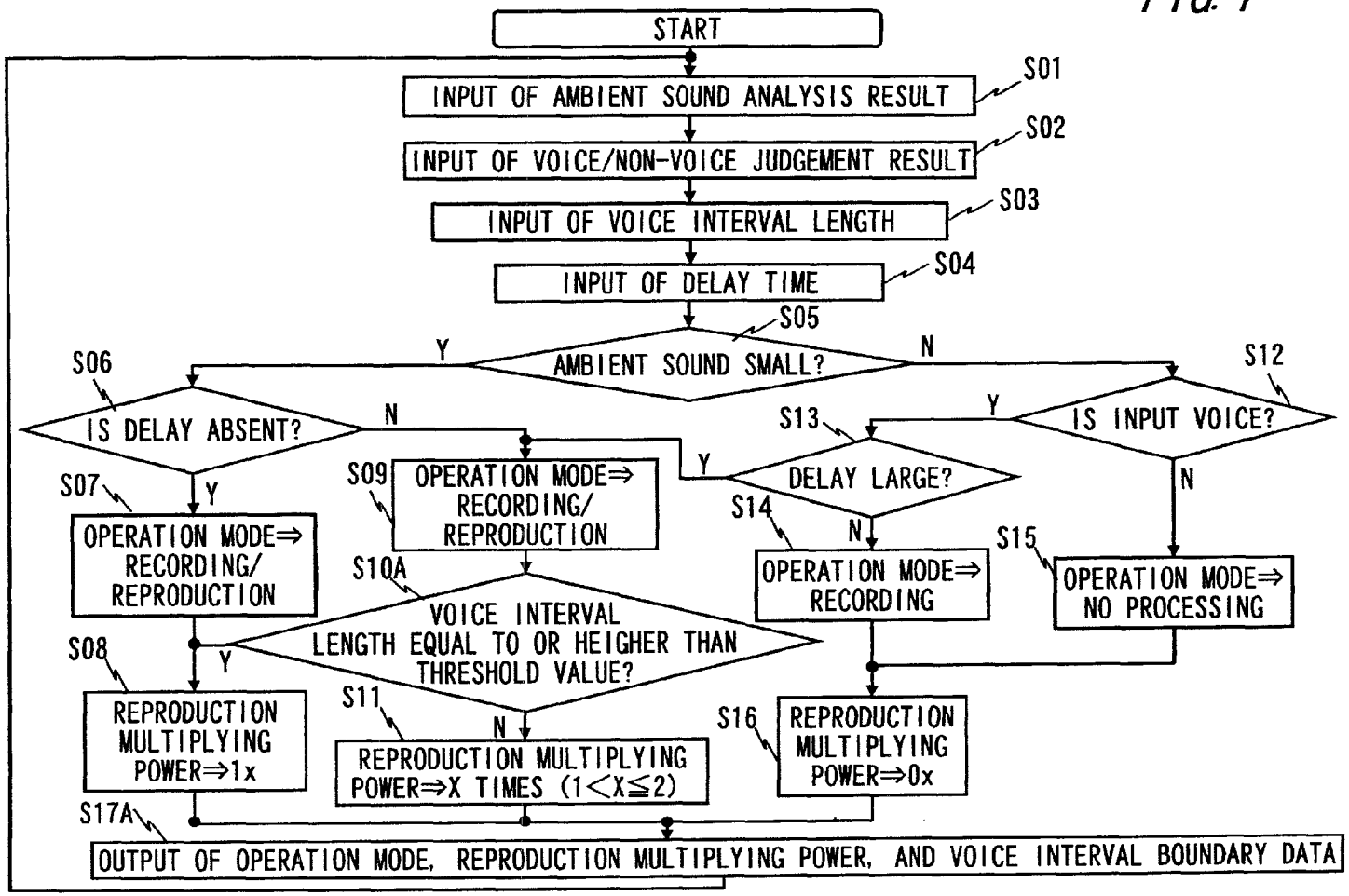
FIG. 7 illustrates a flow chart illustrating an exemplary process performed by a control unit of the voice reproduction apparatus according to the third embodiment.

FIG. 7 illustrates a flow chart illustrating an exemplary process performed by the control unit 5 of the voice reproduction apparatus 1B according to the third embodiment. The process illustrated in FIG. 7 is different from the process of the control unit 5 in the second embodiment (FIG. 3) in relation to the following points or features.

That is, in Step S03A, the control unit 5 receives the voice interval length from the characteristic analysis unit 4A. Accordingly, the control unit 5 generates the voice interval boundary data, determined from the voice interval length, on the buffer 61.

Further, in Step S10A, the control unit 5 judges whether or not the voice interval length of the data to be read and reproduced from the buffer 61 is equal to or more than a preset threshold value Th4. In this procedure, when the voice interval length is equal to or more than the threshold value TH4 (S10A YES), then the process proceeds to Step S08, and the reproduction multiplying power is set to 1×. On the other hand, when the voice interval length is less than the threshold value TH4 (S10A NO), the reproduction multiplying power is set to X times ($1<X\leqq 2$).

Further, in Step S17A, the voice interval boundary data is given to the reproduction timing adjusting unit 6 together with the operation mode. The operation mode and the voice interval boundary data are stored in the internal memory included in the reproduction timing adjusting unit 6.

The process of the control unit 5 is the same as that in the second embodiment except for the foregoing features, and hence any explanation thereof will be omitted.

Figure 8:
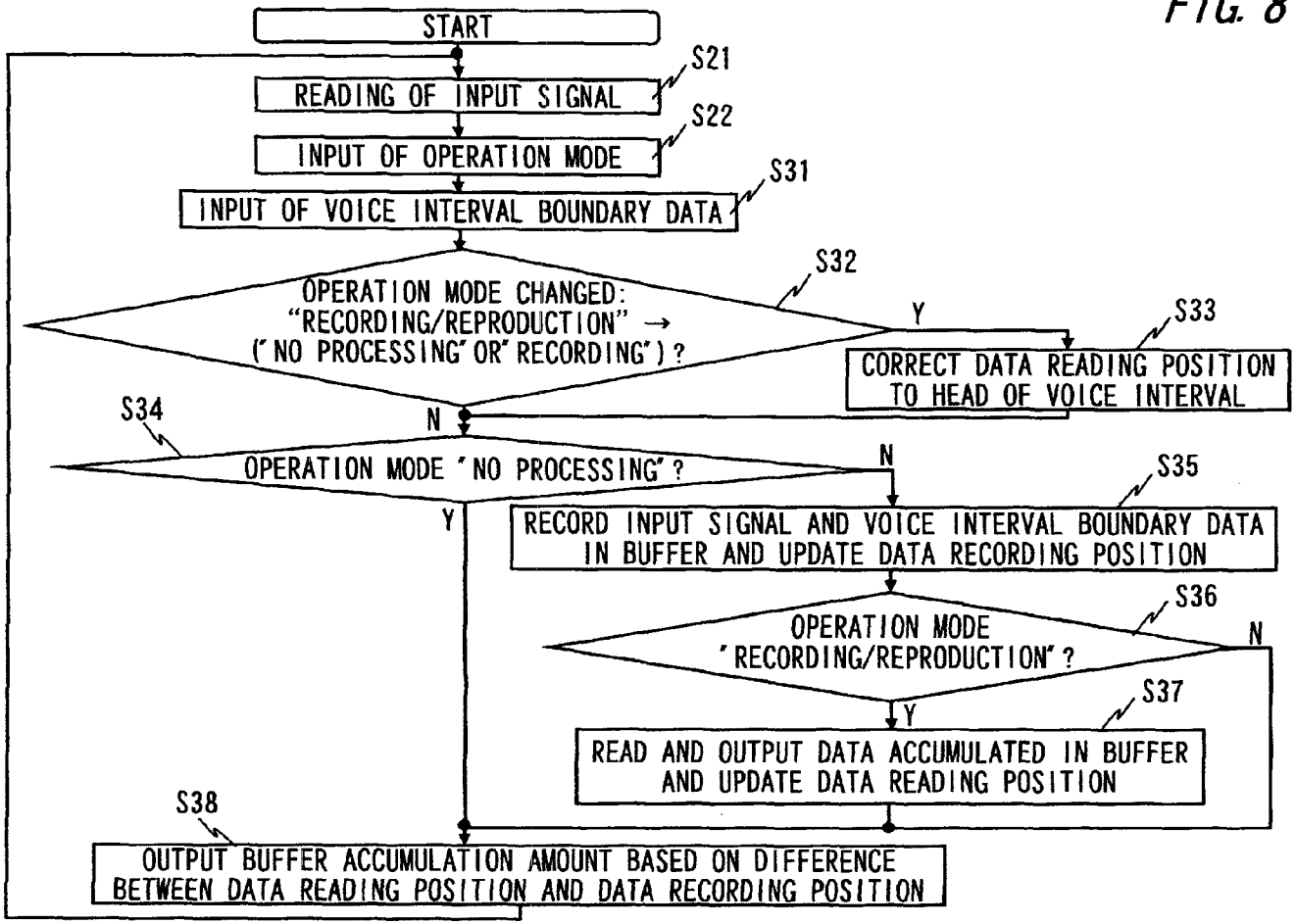
FIG. 8 illustrates a flow chart illustrating an exemplary process performed by a reproduction timing adjusting unit according to the third embodiment.

FIG. 8 illustrates a flow chart illustrating an exemplary process performed by the reproduction timing adjusting unit 6 in the third embodiment. Steps S21 and S22 illustrated in FIG. 8 are the same as those of the process described in the second embodiment (FIG. 4).

In Step S31, the reproduction timing adjusting unit 6 receives the voice interval boundary data and stores the voice interval boundary data in the internal memory.

Subsequently, the reproduction timing adjusting unit 6 judges whether or not the operation mode is changed, i.e., whether or not the operation mode "recording/reproduction" is changed to any other operation mode ("no processing" or "recording") (Step S32). If the operation mode "recording/reproduction" is changed to any other operation mode (S32 YES), the process proceeds to Step S33. If the operation mode "recording/reproduction" is not changed to any other operation mode (S32 NO), the process proceeds to Step S34.

In Step S33, the reproduction timing adjusting unit 6 corrects the data reading position managed by the reproduction timing adjusting unit 6 to the head of the voice interval, and the process proceeds to Step S34.

In Step S34, the reproduction timing adjusting unit 6 judges whether or not the operation mode is "no processing". If the operation mode is "no processing" (S34 YES), the process proceeds to Step S38. If the operation mode is not "no processing" (S34 NO), the process proceeds to Step S35.

In Step S35, the reproduction timing adjusting unit 6 records the signal for reproduction and the voice interval boundary data in the buffer 61, and the data recording position is updated.

Subsequently, the reproduction timing adjusting unit 6 judges whether or not the operation mode is "recording/reproduction" (Step S36). In this procedure, if the operation mode is "recording/reproduction" (S36 YES), the process proceeds to Step S37. If the operation mode is not "recording/reproduction" (S36 NO), the process proceeds to Step S38.

In Step S37, the recording/reproducing unit 63 of the reproduction timing adjusting unit 6 reads the data from the head of the voice interval on the basis of the data reading position, and the signal for reproduction is generated and output (Step S38).

According to the third embodiment, if the voice interval length is smaller than the preset threshold value TH4, the process to quicken the speaking speed is performed in accordance with the speaking speed converting process by the reproduction speed changing unit 7 with respect to the voice signal read from the buffer 61 in the operation mode "recording/reproduction". As for the reproduction speed changing process, the time delay can be restored without lowering the natural feature by changing the speaking speed while maintaining the pitch frequency of the original voice by using the speaking speed converting technique. As for the speaking speed converting technique, it is possible to apply, for example, a technique described in Patent Document 4 (Japanese Laid-Open Patent Publication No. 2007-003682).

Accordingly, the voice reproduction apparatus 1B can restore the time delay without lowering the natural feature while maintaining the pitch frequency of the original voice by using the speaking speed converting technique in the reproduction speed changing unit 7.

In the reproduction timing adjusting operation in the third embodiment, the reading position of the buffer 61 which accumulates the voice signal of the voice interval is set to the start position of the voice interval analyzed by the voice analysis unit 4A. Accordingly, when the ambient sound is decreased, the voice signal is reproduced while being retraced to the head of the voice interval. Accordingly, it is possible to avoid any decrease in the easiness of hearing.

According to the voice reproduction apparatus 1B of the third embodiment, it is possible to quicken the reproduction speed, for example, for the voice interval such as "hmm" and "uh" in which the voice interval length is short. Accordingly, it is possible to restore the time delay without lowering the easiness of hearing of the reproduced sound.

Fourth Embodiment

Next, a voice reproduction apparatus according to a fourth embodiment will be explained. The fourth embodiment is constructed commonly to the third embodiment. Therefore, the common points or features are omitted from the explanation, and different points or features will be principally explained.

In the fourth embodiment, an explanation will be made about the voice reproduction apparatus in which the reproduction timing can be adjusted and the reproduction speed can be changed corresponding to the result of learning of the situation of generation or occurrence of the ambient noise and the voice interval length included in the input signal read from the memory.

Figure 9:
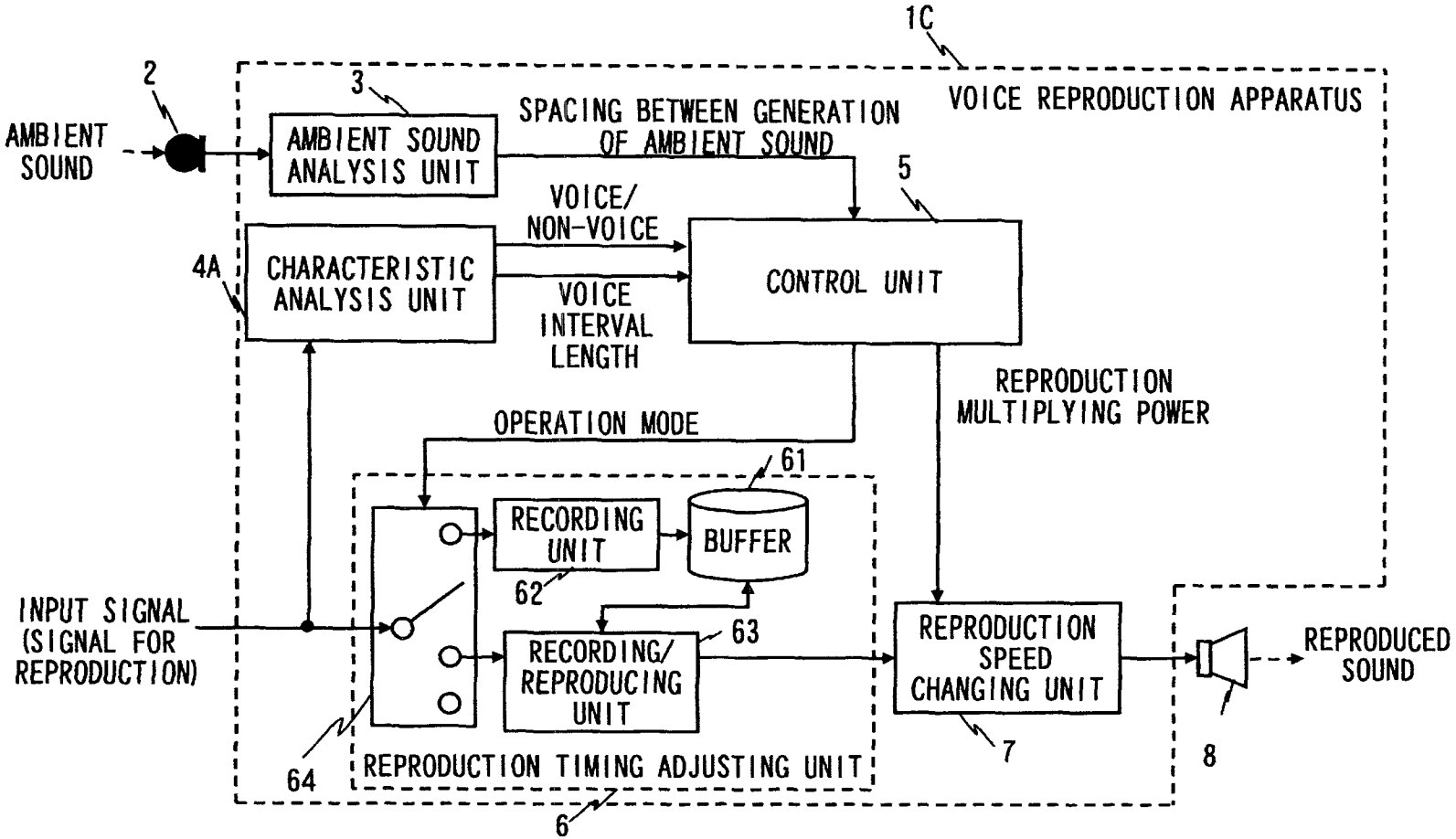
FIG. 9 illustrates a diagram illustrating an exemplary arrangement of a voice reproduction apparatus according to a fourth embodiment.

FIG. 9 is a diagram illustrating an exemplary arrangement of the voice reproduction apparatus 10 according to the fourth embodiment. The constitutive elements of the voice reproduction apparatus 10 are different in relation to the following points or features as compared with the voice reproduction apparatus 1B of the third embodiment 1B (FIG. 6).

(1) The voice reproduction apparatus 1C has an ambient sound analysis unit 3A in place of the ambient sound analysis unit 3. In the ambient sound analysis unit 3A, the ambient sound (noise), which is supplied from the microphone 2, is read into the internal memory to learn the spacing between the generation of the ambient sound. That is, the ambient sound analysis unit 3A measures the spacing between the intervals (noise intervals) in which the noise level is equal to or more than the threshold value TH1. A statistical amount such as an average or a variance, which relates to the spacing from the end of a certain noise interval to the start of the next noise interval, is calculated as the spacing between the generation of the ambient sound. The spacing between the generation of the ambient sound is input into the control unit 5.

(2) The delay time measuring unit 9 (FIG. 6) is omitted. Therefore, the delay time, which is based on the accumulation amount of the buffer 61, is not given to the control unit 5.

(3) The control unit 5 determines the reproduction speed and the operation mode of the reproduction timing adjusting unit 6 on the basis of the spacing between the generation of the ambient sound supplied from the ambient sound analysis unit 3A, the judgment result of the voice/non-voice supplied from the characteristic analysis unit 4A, and the voice interval length.

The arrangement of the voice reproduction apparatus 1C is approximately the same as the arrangement of the voice reproduction apparatus 1B except for the foregoing features.

Figure 10:
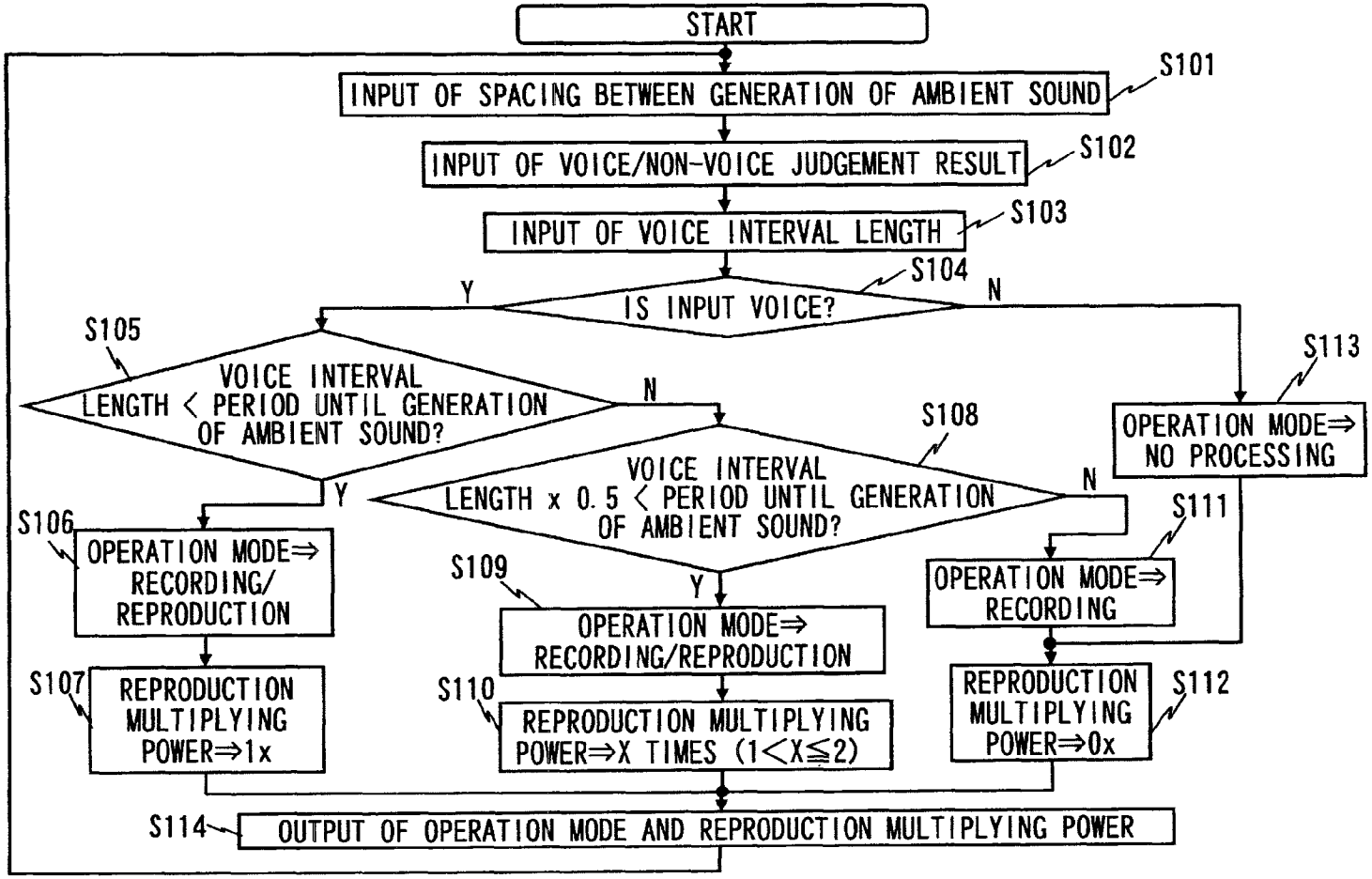
FIG. 10 illustrates a flow chart illustrating an exemplary process performed by a control unit according to the fourth embodiment.

FIG. 10 illustrates a flow chart illustrating an exemplary process performed by the control unit 5 of the voice reproduction apparatus 1C according to the fourth embodiment. The process illustrated in FIG. 10 can be started by using, for example, the trigger of the fact that a power source of the voice reproduction apparatus 1C is turned ON.

The control unit 5 receives the information about the spacing between the generation of the ambient sound as the learning result from the ambient sound analysis unit 3A, and the information is read into the internal memory (not illustrated) included in the control unit 5 (Step S101). The information about the spacing between the generation of the ambient sound can include, for example, the spacing time length and the estimated time of the next generation of the noise determined on the basis of the spacing time length.

Subsequently, the control unit 5 receives the judgment result of the voice/non-voice with respect to the signal for reproduction from the characteristic analysis unit 4A, and the judgment result is read into the internal memory (Step S102).

Subsequently, the control unit 5 receives the voice interval length from the characteristic analysis unit 4A, and the voice interval length is read into the internal memory (Step S103).

Subsequently, the control unit 5 judges whether or not the signal for reproduction, which is input into the reproduction timing adjusting unit 6, is the voice signal by using the judgment result of the voice/non-voice (Step S104). In this procedure, when the signal for reproduction is the voice signal (S104 YES), the process proceeds to Step S105. On the other hand, when the signal for reproduction is the non-voice signal (S104 NO), the process proceeds to Step S113.

In Step S105, the control unit 5 judges whether or not the voice interval length of the voice signal is shorter than the period until the generation of the ambient sound. The period until the generation of the ambient sound can be determined from the estimated time of the generation of the noise and the present time.

When the voice interval length is shorter than the period until the generation of the ambient sound (S105 YES), the control unit 5 allows the process to proceed to Step S106 on the basis of the assumption that the reproduction of the voice signal is completed before the ambient sound is generated. On the other hand, when the voice interval length is equal to or more than the period until the generation of the ambient sound (S105 NO), the control unit 5 allows the process to proceed to Step S108 on the basis of the assumption that the ambient sound is generated before the reproduction of the voice signal is completed.

In Step S106, the control unit 5 sets the operation mode to "recording/reproduction". Subsequently, the control unit 5 sets the reproduction multiplying power to 1× (Step S107). After that, the control unit 5 outputs the operation mode "recording/reproduction" to the reproduction timing adjusting unit 6, and the control unit 5 outputs the reproduction multiplying power "1×" to the reproduction speed changing unit 7 (Step S114). After that, the process returns to Step S101.

In the meantime, if the process proceeds to Step S108, the control unit 5 judges whether or not the product (½ of the voice interval length), which is obtained by multiplying the voice interval length by 0.5, is shorter than (less than) the period until the generation of the ambient sound.

In this procedure, if ½ of the voice interval length is shorter than the period until the generation of the ambient sound (S108 YES), the process proceeds to Step S109. On the other hand, if ½ of the voice interval length is equal to or more than the period until the generation of the ambient sound (S108 NO), the process proceeds to Step S111.

In Step S109, the control unit 5 sets the operation mode to "recording/reproduction". Subsequently, the control unit 5 sets the reproduction multiplying power to X times ($1<X\leqq 2$) (Step S110). In this procedure, the value of X can be determined, for example, on the basis of the dimension of the voice interval length.

After that, the control unit 5 outputs the operation mode "recording/reproduction" to the reproduction timing adjusting unit 6, and the control unit 5 outputs the reproduction multiplying power "X times" to the reproduction speed changing unit 7 (Step S114). After that, the process returns to Step S101.

If the process proceeds to Step S111, the control unit 5 sets the operation mode to "recording". Subsequently, the control unit 5 sets the reproduction multiplying power to 0× (Step S112).

After that, the control unit 5 outputs the operation mode "recording" to the reproduction timing adjusting unit 6, and the control unit 5 outputs the reproduction multiplying power "0×" to the reproduction speed changing unit 7 (Step S114). After that, the process returns to Step S101.

If the process proceeds to S113, the control unit 5 sets the operation mode to "no processing". Subsequently, the control unit 5 sets the reproduction multiplying power to 0× (Step S112).

After that, the control unit 5 outputs the operation mode "no processing" to the reproduction timing adjusting unit 6, and the control unit 5 outputs the reproduction multiplying power "0×" to the reproduction speed changing unit 7 (Step S114). After that, the process returns to Step S101.

According to the voice reproduction apparatus 1C of the fourth embodiment, the ambient sound analysis unit 3 learns the spacing of the ambient sound which is given to the control unit 5. The control unit 5 compares the voice interval length with the period until the next generation of the ambient sound (noise). If the reproduction of the voice signal is completed until the next generation of the noise, the control is performed so that the simultaneous recording/reproduction is performed at 1× speed.

On the other hand, when the period until the next generation of the ambient sound is longer than the voice interval length, if the voice signal of the voice interval length is reproduced, then there is such a possibility that the ambient sound may be generated during the reproduction. In this case, the control unit 5 compares the half length of the voice interval length (voice interval length/2) with the period until the next generation of the ambient sound. If the value of the voice interval length/2 is shorter than the period until the next generation of the ambient sound, the control is performed so that the simultaneous recording/reproduction is performed at X times speed.

If the value of the voice interval length/2 is equal to or more than the period until the next generation of the ambient sound, then only the recording of the voice signal is performed, and the reproduction timing is delayed so that the reproduction is performed during the spacing of the ambient sound. Accordingly, the reproduction can be performed without causing any overlap with the noise, and the reproduced sound can be easily heard, without excessively quickening the reproduction speed and decreasing the easiness of listening.

According to the embodiments described above, the signal for reproduction, which is input when any noise is generated, can be reproduced or played back within a short time when the noise is absent.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A voice reproduction apparatus comprising:

an ambient sound analysis unit to analyze a characteristic of an ambient sound;

a characteristic analysis unit to analyze an acoustic characteristic of a signal for reproduction;

a reproduction timing adjusting unit to record the signal for reproduction on a recording medium on one hand and to read the signal for reproduction from the recording medium at a reproduction timing of follow-up reproduction on the other hand;

a reproduction speed changing unit to change a reproduction speed of the signal for reproduction read from the recording medium; and a control unit to control the reproduction timing adjusting unit so that the signal for reproduction is reproduced at the reproduction timing corresponding to an analysis result of the ambient sound analysis unit on one hand and to control the reproduction speed changing unit so that the signal for reproduction is reproduced at the reproduction speed corresponding to the analysis result of the ambient sound analysis unit and the acoustic characteristic obtained by the characteristic analysis unit on the other hand.

2. The voice reproduction apparatus according to claim 1, wherein:

the analysis result of the ambient sound analysis unit includes an ambient sound level; and the control unit controls the reproduction timing adjusting unit so that the signal for reproduction is recorded on the recording medium during a period in which the ambient sound level is equal to or more than a predetermined level threshold value, and the signal for reproduction, which is recorded on the recording medium, is subjected to the follow-up reproduction during a period in which the ambient sound level is less than the predetermined threshold value.

3. The voice reproduction apparatus according to claim 2, further comprising:

a measuring unit to measure a delay time corresponding to an amount of accumulation in the recording medium, wherein:

the control unit performs control so that the signal for reproduction is recorded on the recording medium when the ambient sound level is equal to or more than the predetermined level threshold value and the delay time is smaller than a predetermined delay threshold value.

4. The voice reproduction apparatus according to claim 3, wherein the control unit controls the reproduction timing adjusting unit so that the follow-up reproduction is performed with the signal for reproduction recorded on the recording medium when the ambient sound level is equal to or more than the predetermined level threshold value but the delay time is equal to or more than the predetermined time threshold value.

5. The voice reproduction apparatus according to claim 1, wherein:

the acoustic characteristic, which is obtained by the characteristic analysis unit, includes a judgment result to indicate whether the signal for reproduction is a voice signal or a non-voice signal; and the control unit controls the reproduction timing adjusting unit so that recording is performed on the recording medium when the signal for reproduction is the voice signal, while recording is not performed on the recording medium when the signal for reproduction is the non-voice signal.

6. The voice reproduction apparatus according to claim 1, wherein:

the acoustic characteristic, which is obtained by the characteristic analysis unit, includes a pitch frequency of the signal for reproduction as a voice signal; and the control unit controls the reproduction speed changing unit so that the signal for reproduction is reproduced at the reproduction speed corresponding to the pitch frequency.

7. The voice reproduction apparatus according to claim 1, wherein:

the acoustic characteristic, which is obtained by the characteristic analysis unit, includes a voice interval length of the signal for reproduction as a voice signal; and the control unit controls the reproduction speed changing unit so that the signal for reproduction is reproduced at the reproduction speed corresponding to the voice interval length.

8. The voice reproduction apparatus according to claim 1, wherein:

the acoustic characteristic, which is obtained by the characteristic analysis unit, includes a voice interval length of the signal for reproduction as a voice signal; and the control unit controls the reproduction timing adjusting unit so that the signal for reproduction, which is recorded on the recording medium, is read while being retraced to a head of the signal for reproduction on the basis of the voice interval length.

9. The voice reproduction apparatus according to claim 1, wherein:

the analysis result of the ambient sound analysis unit includes a spacing of the ambient sound which is generated periodically;

the acoustic characteristic, which is obtained by the characteristic analysis unit, includes a voice interval length of the signal for reproduction as a voice signal; and the control unit controls the reproduction speed changing unit so that the signal for reproduction is reproduced at the reproduction speed based on a relationship between the voice interval length and a time length from a present time to a time of next generation of the ambient sound as determined from the spacing of the ambient sound.

10. The voice reproduction apparatus according to claim 9, wherein the control unit performs controls so that the signal for reproduction is recorded on the recording medium without being reproduced, when a length of the voice interval length, which is obtained when the reproduction speed is maximized, is longer than the time length.

11. The voice reproduction apparatus according to claim 1, wherein:

the ambient sound analysis unit learns a situation of generation of the ambient sound; and the control unit controls the reproduction timing adjusting unit so that the reproduction timing of the signal for reproduction is shifted on the basis of a result of learning of the generation of the ambient sound.

12. A voice reproduction method comprising:

analyzing a characteristic of an ambient sound;

analyzing an acoustic characteristic of a signal for reproduction; and performing control so that the signal for reproduction is reproduced at a reproduction timing corresponding to an analysis result of the ambient sound and at a reproduction speed corresponding to the acoustic characteristic.

* * * * *